United States Patent [19]

Schonwetter et al.

[11] 4,397,045

[45] Aug. 9, 1983

[54] LINER FOR FIRE HELMET OR THE LIKE

[76] Inventors: Sarah Schonwetter; Steven B. Schonwetter, both of 585 Warren Ave., Kingston, Pa. 18704

[21] Appl. No.: 203,378

[22] Filed: Nov. 3, 1980

[51] Int. Cl.[3] ..... A42B 1/06; A42B 3/00

[52] U.S. Cl. ..... 2/5; 2/7; 2/172; 2/423

[58] Field of Search ..... 2/5, 7, 172, 410, 423, 2/8, 203, 205, 209

[56] References Cited

U.S. PATENT DOCUMENTS

| | | | |
|---|---|---|---|
| 1,566,663 | 12/1925 | Finkelstein | 2/172 |
| 2,286,843 | 6/1942 | Catalane et al. | 2/410 |
| 3,055,012 | 9/1962 | Aileo | 2/410 |
| 3,512,180 | 5/1970 | Bonk et al. | 2/172 |
| 3,535,706 | 10/1970 | Aileo | 2/5 |
| 3,594,814 | 7/1971 | Schuessler | 2/410 |
| 4,231,118 | 11/1980 | Nakagawa | 2/7 |

*Primary Examiner*—Peter P. Nerbun
*Attorney, Agent, or Firm*—Diller, Ramik & Wight

[57] ABSTRACT

This disclosure relates to a liner particularly adapted for use in high temperature environments, such as are encountered by fire fighters, and includes a crown defining a generally concave interior which receives the head of a wearer and ends in a bottom terminal peripheral edge portion to which is attached by a sewn seam an upper terminal peripheral edge portion of a neck and ear covering and protecting flap with the seam allowing relative folding between the flap and the crown between a position at which the flap is interiorly of the crown and a position at which the flap is exteriorly of the crown, the flap being of a generally downwardly and inwardly converging configuration when disposed exteriorly of the crown whereby the neck and ears of a wearer of the liner are intimately covered, whereas when disposed interiorly of the crown, the flap conforms generally to the configuration thereof and comfortably receives the head of a wearer, and the ear covering and protecting flap being constructed from at least two plies of material with an outermost of the plies when the flap is exterior of the crown being formed of aluminum foil and the other of the plies of material being a fabric, such as aramid felt.

9 Claims, 4 Drawing Figures

FIG.1
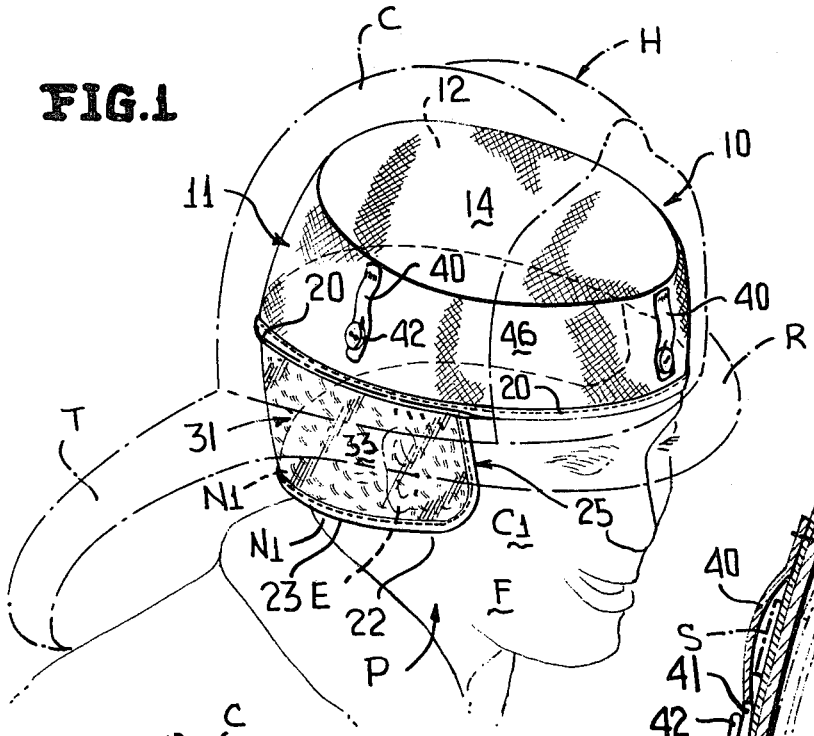
FIG.3
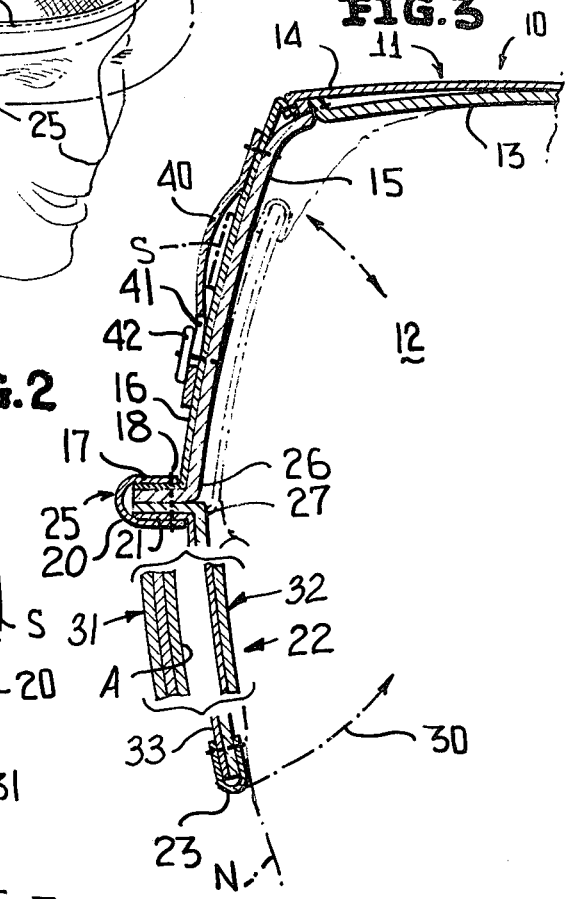
FIG.2
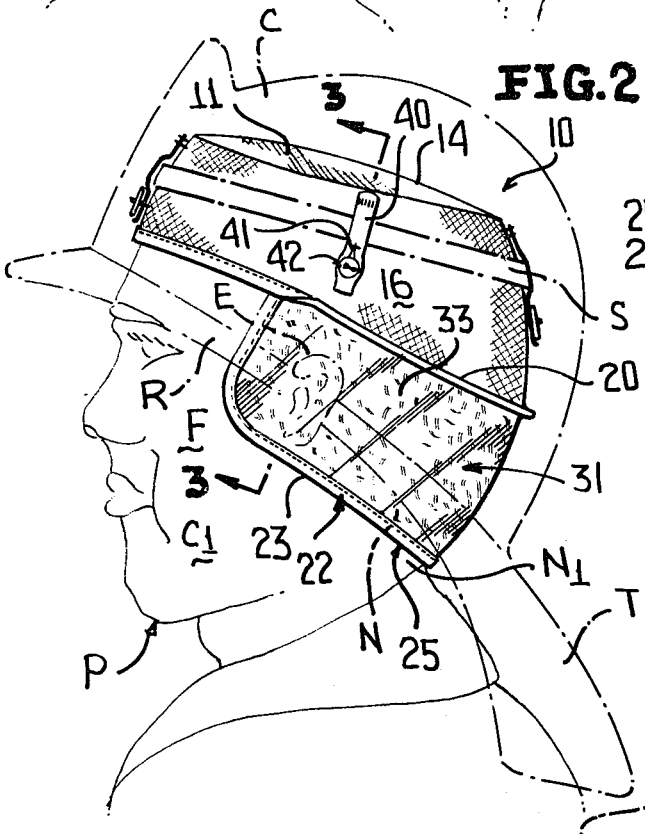
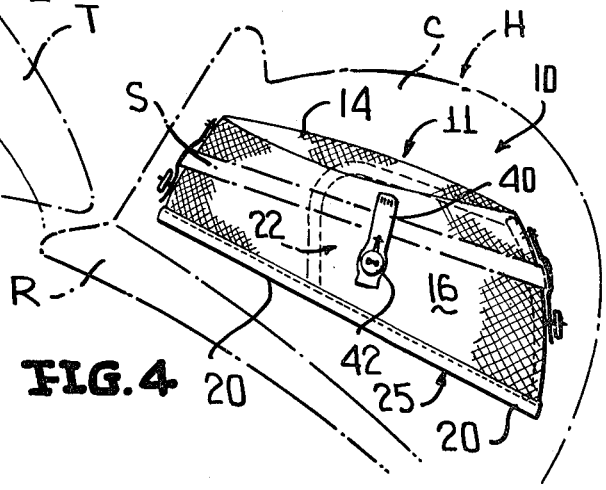
FIG.4

LINER FOR FIRE HELMET OR THE LIKE

The present invention is directed to a helmet liner specifically adapted for utilization within the hat of a fire fighter or anyone else who might be subject to high temperature environments, such as members of rescue squads, emergency crews, rescue teams or emergency personnel of most any type who might encounter relatively high temperatures. Such persons might wear, for example, typical metallic, plastic or composite firemen's helmets within which would be located the helmet liner of this invention. Though a fireman's hat has a conventional brim or rim and a rearward and downward protecting "tail", the latter afford protection to the wearer's head from falling debris, but the protection afforded against high temperatures or elevated temperatures is negligible since the wearer's ears, back of the head and the neck are subject to both direct and indirect exposure to heat and, of course, the ears, back of the head and neck are highly sensitive to high temperatures. Thus, in accordance with this invention a helmet or hat liner is designed such that a conventional crown thereof is attached by a permanent foldable seam to a neck and ear covering and protecting flap, the seam being constructed and arranged for relatively folding the neck and ear covering protecting flap from a position generally wholly interiorly of the crown to a position generally wholly exteriorly of the crown with the flap being of a generally downwardly and inwardly converging relationship when disposed exteriorly of the crown, whereby the neck and ears of a wearer of the liner are intimately covered, whereas when disposed interiorly of the crown, the flap conforms generally to the configuration of the crown and comfortably receives the head of a wearer, and at least the flap being constructed from two plies of material, and an exterior of the plies of material when the flap is positioned generally wholly exteriorly of the crown being constructed of aluminum foil.

Still another object of this invention is to provide a novel helmet, fire hat, or like liner in which the material of the flap most immediate adjacent a wearer's ear and neck when the flap is generally wholly exteriorly of the crown is aramid felt or like fabric.

Still another object of this invention is to provide a novel helmet of the type aforesaid wherein the first or one ply is an aluminum foil/copolymeric plastic film/aluminum foil laminate with a first of the aluminum foils being positioned outermost when the neck and ear covering and protecting flap is disposed exteriorly of the crown, and a remaining one of the aluminum foils is adhesively bonded to the other of the plies which is aramid felt.

Yet another object of this invention is to provide a novel helmet liner as set forth heretofore wherein the crown terminates in a bottom terminal peripheral edge portion and with the upper terminal peripheral edge portion of the flap projects laterally outwardly when the neck and ear covering and protecting flap is disposed exteriorly of the crown, yet projects downwardly when the neck and ear covering and protecting flap is disposed interiorly of the crown with the seam formed therealong and therefrom tending to normally urge the flap from its exterior toward its interior position relative to the crown.

Still another object of this invention is to provide a novel helmet liner of the type aforesaid wherein the sewn seam is relatively permanent and further includes a strip of material of a generally U-shaped transverse cross-sectional configuration within which is received the bottom terminal peripheral edge portion and the upper terminal peripheral edge portion of the crown and flap, respectively.

With the above and other objects in view that will hereinafter appear, the nature of the invention will be more clearly understood by reference to the following detailed description, the appended claims and the several views illustrated in the accompanying drawings.

IN THE DRAWINGS

FIG. 1 is a perspective view of a novel helmet liner of this invention, and illustrates the liner positioned upon the head of a wearer with a fire helmet or fire hat being shown positioned thereatop.

FIG. 2 is a side elevational view of the helmet liner of FIG. 1, and illustrates the manner in which a neck and ear covering and protecting flap intimately conforms to the rear and sides of a wearer's neck, covers the ears thereof and the stippling indicates aluminum foil exteriorly of the flap for protecting the wearer from high temperature environments.

FIG. 3 is an enlarged cross sectional view taken generally along line 3—3 of FIG. 2, and illustrates the manner in which a permanent seam is formed by bottom and top portions of the crown and flap of the liner, respectively, and a generally U-shaped strip of material seamed thereto with the flap being deflectable from a solid outline position generally exteriorly of the crown to an interior position shown in phantom outline, and vice versa.

FIG. 4 is side elevational view of the helmet liner similar to FIG. 2, and illustrates the neck and ear covering and protecting flap disposed wholly inboard of the liner crown.

FIGS. 1, 2 and 4 of the drawings illustrate in phantom outline a conventional helmet H which may be, for example, a firemen's helmet or hat constructed of metallic, plastic or composite fire resistant or fire retardant and protecting material, such as steel, which includes a crown C, a rim R, and a downwardly directed neck protecting hood or "tail" T. The helmet H includes internal webbing including a strap S of a conventional construction. Obviously, the helmet H is intended to be worn upon the head of a person P in a conventional fashion and protect the person P from falling debris and, obviously, in the case of a fire hat or helmet H also protect against flames or like high temperature environments. However, such helmets afford little protection to the ears, sides, back of the head and neck of a wearer, both relative to direct flames and indirect hot air which, obviously, can reach these sensitive areas of the person P from beneath the rim R. Therefore, though conventional fire helmets or hats H or like emergency helmets or hats afford a limited amount of protection against high temperature environments, they do not afford that degree of protection necessary to firemen or like persons P who are subject to high temperature environments (fires) on a dangerously repetitive basis.

In keeping with the foregoing, a primary object of this invention is to provide a novel fire hat, emergency helmet or like liner which is particularly adapted for use in high temperature environments, such as fires, explosions, or the like, with the helmet liner being generally designated by the reference numeral 10 and including a crown 11 defining a generally concave interior 12. The crown 11 includes an interior generally circular or oval shaped top panel 13 and an exteriorly generally circular or oval shaped top panel 14, each of which is respectively joined by stitching (unnumbered) to an interior peripheral panel 15 and an exterior peripheral panel 16. The panels 13, 15 may be constructed from cotton, wool or similar moisture absorbing fabric, while the panels 14, 16 are preferably constructed from stronger more durable fabric, such as nylon, denim, reinforced cotton, etc. The lowermost edges (singularly unnumbered) of the panels 15, 16 collectively define a bottom terminal peripheral edge portion 17 of the crown 11 which generally encapsulates the head of a wearer or person P. The bottom terminal peripheral edge portion 17 is united by stitching 18 and a strip of material 20 to an upper terminal peripheral edge portion 21 of a neck and ear covering and protecting flap 22.

The neck and ear covering and protecting flap 22, hereinafter simply termed "flap", is formed of a plurality of plies of material and normally occupies one of two positions, namely, an in-use position shown in solid lines in FIG. 3 in which the flap 22 covers and protects the ears E and the portion of the head and neck of the wearer P located therebetween which portion is generally designated by the reference character N. The flap 22 when so disposed generally wholly exteriorly of the crown 12, again as shown in solid lines in FIG. 3, not only covers the ears E and the back of the head and neck N of the wearer P, but also conforms intimately to the wearer's head and neck, as evidenced best in FIG. 2 of the drawings. Thus, it is virtually impossible for flames or high temperature air to flow between a seamed bottom edge 23 of the flap 22 and those portions of the wearer's face F, cheek C1, and neck portions N1 against which the seamed bottom edge 23 intimately engages by virtue of the generally downwardly and inwardly contoured concaved configuration thereof.

Reference is again made specifically to FIG. 3 which illustrates the strip of material 20 as being generally U-shaped or inverted C-shaped in transverse cross-section, and collectively with the edge portions 17, 21 and the stitching 18 defines a seam 25 which when the flap 22 is in its position exteriorly of the crown, projects transversely outwardly, as is shown in solid lines in FIG. 3. Since the material of the peripheral panels 15, 16 and that of the flap 22 normally attempt to return to their planar configuration, forces are set up by this natural tendency of the material and the folds or bends 26, 27 to move the flap 22 continuously inwardly as indicated by the arrow 30 in FIG. 3. These forces 30 obviously therefore further urge the flap 22 into intimate engagement with the face F, ears E, cheek C1, neck N1, and neck and back of the head portions N, of the wearer P to again assure that hot air can not readily seep or flow between the seam bottom edge 23 and the latter-mentioned portions of the wearer or person P. Obviously, when the flap 22 is disposed generally entirely within the interior 12 of the crown 11, as indicated in phantom outline in FIG. 3, the seam 25 returns to its "normal" position which is downwardly directed along the entire periphery thereof, as is best illusrated in FIG. 4, and in this position the material of the liner 10 has enough "give" to still adequately accommodate the head of the wearer. Furthermore, since the material of the portions 15, 16 and that of the flap 12 is in the "normal" or unstressed condition thereof, the folds or bends 26, 27 are nonexistent and, therefore, the flap 22 remains positioned within and in close conformity to the portion 15 of the interior 12 even when the liner is removed from the head of the wearer P.

The flap 22 when disposed exteriorly of the crown interior 12 and in the protecting position shown in FIGS. 1 and 2 must, of course, resist or retard flames or hot air which would burn or otherwise affect the relatively sensitive areas normally covered by the flap 22. To this end the flap 22 is preferably constructed from two plies of material, an external ply 31 and an internal ply 32. The external ply 31 is a laminate of aluminum foil or aluminum coating or aluminum coating/plastic copolymer/aluminum foil or aluminum coating or aluminum coating with only the exterior ply of aluminum foil or aluminum coatng or coating being illustrated by stippling and being generally designated by the reference numeral 33. The intermediate plastic copolymer is merely a binder between the two aluminum foils and the inner aluminum foil (unnumbered) is secured by an adhesive A to the interior ply 32 which is preferably aramid felt fabric which may be purchased from Gentex Corporation of Carbondale, Pennsylvania 18407. The composite fabric including the aluminized ply 31 is available from the latter-identified corporation under their fabric type #1055HT1 Aramid Felt Aluminized fabric and/or as their Gentex No. 1055 aluminized aramid felt fabric. The aramid felt is similar in appearance and "hand" to wool but since lighter than wool, it does not provide as much heat resistance at high temperatures but due to its inherent softness lends itself to fabricating operations and provides wear comfort. However, it is the outer aluminized ply 31 of aluminum foil or aluminum coating or aluminum coating/plastic copolymer/aluminum foil or aluminum coating or aluminum coating which affords the heat resistance, low flamability and low temperature resistance necessary in high temperature environments of the type heretofore noted. Thus, the materials from which the flap 22 is constructed, the contour of the flap 22, and the provision of the seam 25 which sets up the forces 30 urging the flap 22 inwardly or intimately against the portions of the wearer heretofore described that create collectively a unique helmet liner which in use in high temperature environments protects the wearer P in manners heretofore unprovided for in industry.

The liner 10 is, of course, provided with conventional securing straps 40 which are sewn at one end to the portions 15, 16, as is best illustrated in FIG. 3, while opposite ends have slots 41 for receiving buttons 42 which are likewise sewn to the portions 15, 16 (FIG. 3). The strap S of the helmet webbing can, therefore, be secured by the straps 40 in the manner readily apparent in FIG. 2 to permit the liner 10 to be readily secured to or removed from the interior of the hat H. The latter structure is, however, most conventional.

Although only a preferred embodiment of the invention has been specifically illustrated and described herein, it is to be understood that minor variations may be made in the apparatus without departing from the spirit and scope of the invention, as defined in the appended claims.

We claim:

1. A helmet liner particularly adapted for use in high temperature environments comprising a crown defining a generally concave interior adapted to receive the head of a wearer, said crown including a bottom terminal peripheral edge portion, a neck and ear covering and protecting flap disposed along said bottom terminal peripheral edge portion, a sewn seam defined in part by said bottom terminal peripheral edge portion and an upper terminal peripheral edge portion of said neck and ear covering and protecting flap, said seam being constructed and arranged for relatively folding said neck and ear covering and protecting flap from a position generally wholly interiorly of said crown to a position generally wholly exteriorly of said crown, said neck and ear covering and protecting flap being of a generally downwardly and inwardly converging relationship when disposed exteriorly of said crown whereby the neck and ears of a wearer of the liner are intimately covered whereas when disposed interior of said crown said ear covering and protecting flap conforms generally to the configuration of said crown and confortably receives the head of a wearer, said ear covering and protecting flap being constructed from at least two plies of material, at least one of said plies of material being fire resistant/retardant and heat reflective material, the other of said plies of material being fire resistant/retardant but non-heat reflective material, said at least one ply being positioned outermost when said neck and ear covering and protecting flap is disposed exteriorly of said crown, and said crown being constructed from non-heat reflective material.

2. The helmet liner as defined in claim 1 wherein the other of said plies of material is fire resistant/retardant material, and a further ply of material sandwiched between said at least two plies of material.

3. The helmet liner as defined in claim 1 wherein said at least one ply is aluminum foil and is positioned outermost when said neck and ear covering and protecting flap is disposed exteriorly of said crown and the other of said plies is aramid felt.

4. The helmet liner as defined in claim 1 wherein said at least one ply is an aluminum foil/copolymeric plastic film/aluminum foil laminate with a first of said aluminum foils being positioned outermost when said neck and ear covering and protecting flap is disposed exteriorly of said crown, and a remaining one of said aluminum foils is adhesively bonded to the other of said plies which is aramid felt.

5. The helmet liner as defined in claim 1 wherein said bottom terminal peripheral edge portion and said upper terminal peripheral edge portion project laterally outwardly when said neck and ear covering and protecting flap is disposed exteriorly of said crown and project downwardly when said neck and ear covering and protecting flap is disposed interiorly of said crown.

6. The helmet liner as defined in claim 1 wherein said sewn seam further includes a strip of material of a generally U-shaped transverse cross-sectional configuration within which is received said bottom terminal peripheral edge portion and said upper terminal peripheral edge portion.

7. The helmet liner as defined in claim 5 wherein said sewn seam further includes a strip of material of a generally U-shaped transverse cross-sectional configuration within which is received said bottom terminal peripheral edge portion and said upper terminal peripheral edge portion.

8. The helmet liner as defined in claim 5 wherein said at least one ply is an aluminum foil/copolymeric plastic film/aluminum foil laminate with a first of said aluminum foils being positioned outermost when said neck and ear covering and protecting flap is disposed exteriorly of said crown, and a remaining one of said aluminum foils is adhesively bonded to the other of said plies which is aramid felt.

9. The helmet liner as defined in claim 8 wherein said sewn seam further includes a strip of material of a generally U-shaped transverse cross-sectional configuration within which is received said bottom terminal peripheral edge portion and said upper terminal peripheral edge portion.

* * * * *